US006336477B1

(12) United States Patent
Kutzleb et al.

(10) Patent No.: US 6,336,477 B1
(45) Date of Patent: Jan. 8, 2002

(54) FRAME MODULES FOR IMPROVED WEAVING DEVICE

(75) Inventors: Chester F. Kutzleb, Sagle; Roger King, Sandpoint; Anders Bostrom, Sandpoint; Robert Kellogg, Sandpoint, all of ID (US)

(73) Assignee: WIS Seaming, Sandpoint, ID (US)

( * ) Notice: Subject to any disclaimer, the term of this patent is extended or adjusted under 35 U.S.C. 154(b) by 0 days.

(21) Appl. No.: 09/458,309

(22) Filed: Dec. 10, 1999

(51) Int. Cl.[7] ..... D03C 13/00
(52) U.S. Cl. ..... 139/455; 139/59; 139/85
(58) Field of Search ..... 139/455, 59, 85

(56) References Cited

U.S. PATENT DOCUMENTS 3,865,148 A * 2/1975 Wolfgang et al. ..... 139/59
3,918,500 A * 11/1975 Katsumata ..... 139/59
5,628,347 A * 5/1997 Rush ..... 139/455
5,819,813 A * 10/1998 Dewispelaere ..... 139/455
5,860,454 A * 1/1999 Mista et al. ..... 139/455
5,911,247 A * 6/1999 Waters ..... 139/455
6,041,831 A * 3/2000 Kuoni et al. ..... 139/55.1
6,050,302 A * 4/2000 Guse et al. ..... 139/1 R
6,105,628 A * 8/2000 Duhamel ..... 139/455

FOREIGN PATENT DOCUMENTS

EP 421 370 A1 4/1991

OTHER PUBLICATIONS

Staubli AG brochure; "Name–Weaving Jacquard Machine CX 160"; undated; 6 pages.
Grosse Webereimaschinen GmbH brochure; "Electronic High Speed Jacquard–Machine EJP–3"; undated; 4 pages.

* cited by examiner

*Primary Examiner*—John J. Calvert
*Assistant Examiner*—Robert H. Muromoto, Jr.
(74) *Attorney, Agent, or Firm*—Wells, St. John, Roberts, Gregory & Matkin, P.S.

(57) ABSTRACT

In a weaving device, a weaving device frame mounts a plurality of eyelets. A frame module, releasably borne by the weaving device frame is readily detachable from and controls movement of the respective eyelets. The frame module forms a readily removable component of the weaving device.

46 Claims, 6 Drawing Sheets

FRAME MODULES FOR IMPROVED WEAVING DEVICE

TECHNICAL FIELD

The present invention relates to a frame module for an improved weaving device.

BACKGROUND OF THE INVENTION

Weaving devices, commonly called looms, are known in the art and have been in existence in one or another form for thousands of years. Weaving devices are generally used for producing woven fabric. Generally speaking, weaving devices consist of a frame, a substantially horizontal array of eyelets movably supported by the frame between an upper position and a lower position, and a mechanism for moving the eyelets between the two positions.

To set up a typical weaving device for operation, a thread, or any type of weavable strand, is drawn off a spool and passed through an eyelet of the weaving device, then passed through a guide which is on the opposite side of the eyelet from the spool. The guide may be in the form of a long horizontal slot, or a gap between two horizontal, vertically opposed rollers for example. Each eyelet is threaded in this manner with an individual thread.

Selected eyelets are oriented in the upper position and slightly above the guide, while the remaining eyelets are oriented in the lower position and slightly below the guide. This difference in the relative positions of the eyelets with respect to each other and to the guide, causes the threads to form an upper and lower row of parallel threads. The upper row passes from the upper eyelets to the guide, and the lower row passes from the lower eyelets to the guide. The two rows intersect, or meet, at the guide to form an acute interior corner or angle. This formation of two rows of threads is generally called a shed. Thus, a shed can basically be described as two flat planes, each formed by a row of parallel threads, which meet to form a trough, or corner.

To begin the weaving process a cross-thread, called a weft thread, is placed into the corner of the shed where the threads meet at the guide, and perpendicular to the warp threads. After placement of the weft thread, the position of each eyelet is reversed, that is, the upper eyelets move to the lower position, and the lower eyelets move to the upper position. This change in position of the eyelets not only forms another shed, but also causes the warp threads to partially wrap around the weft thread. A second weft thread is then inserted into the corner of the new shed, and the position of each eyelet is again reversed. This process is continually repeated to form a fabric created from interlacing, or weaving, the warp and weft threads.

Basic woven fabric is produced on weaving devices which move the respective eyelets in a continuously repeating sequence of shed changes to produce a substantially homogeneous fabric pattern. However, a special type of weaving device, called a Jacquard device, may be used, for among other purposes, to weave intricate or varying patterns into the fabric, or to perform seaming operations in which the opposite edges of a piece of fabric are woven together to form an endless ribbon or belt of fabric. Jacquard devices are well known in the art and have been in existence for hundreds of years in various forms. In a Jacquard device, each eyelet is individually selectively movable with respect to each of the shed changes. In other words, the sequence of movements of the eyelets is not merely uniformly repetitive, but may be selectively variable with each shed change. In this manner, varying and stylistically appealing patterns may be woven into the fabric by the weaving device.

Generally speaking, a Jacquard weaving device consists of an array of springs mounted on the top of the frame of the weaving device. An eyelet is attached to each of the springs and depends from the lower end of the spring. The respective springs bias the eyelets toward an upper position. A pulley block is attached to the lower side of each eyelet and depends below the eyelet. A cord is fed or otherwise received through the pulley block and engages the sheave, or pulley wheel of same. The opposite ends of the cord depend from the pulley block. The cord has two hooks attached to it, one on each end.

Attached to the frame, are griff bars which reciprocally move up and down below the pulley block. The griff bars are mechanically linked together so that, as one griff bar moves up, the other correspondingly moves down, and vice versa. An actuator such as an electrical motor is coupled to one of the griff bars to reciprocally move the griff bars at continuously selective and repeating intervals.

The hooks slidably engage guides which are mounted on the frame. The respective guides restrict and direct the path of movement of the hooks such that the path of movement of one of the hooks substantially coincides with one of the griff bars, and the path of movement of the other hook substantially coincides with the other griff bar. Each hook has a slot formed therein which is engaged by the respective griff bar as it moves downwardly. If the hook is held in its lowermost position, the slot formed on the hook allows the griff bar to disengage from the hook and move upwardly while leaving the hook in its lower position.

The cord which extends between the respective hooks is of such a length that the individual springs, located above each of the eyelets, keeps the cord taut at all times. When both hooks are engaged by the respective griff bars, the hooks and cord travel in a seemingly see-saw like motion along with the griff bars. During this motion the cord is pulled back and forth through the pulley block and rollingly engages the sheave. Also during this pattern of motion, the pulley block and eyelet remain substantially stationary (in the upper position) being held in the same position by the tension of the spring.

In these weaving devices the lower end of each hook is engageable by means of a latch which is mounted on the frame and which is located near the bottom of the path of travel of each of the hooks. Each latch selectively captures and retains the respective hook in the lower position. If one of the hooks is held in its lower position by the respective latch, the associated griff bar disengages from the hook as it travels upwardly, leaving the hook retained by the latch in the lower position. As the griff bar moves upwardly, leaving the associated hook retained by the latch, the other hook (attached to the opposite end of the cord) is simultaneously pulled downwardly toward another latch by the other griff bar. Because the first hook is latched in the lower position, and is not allowed to travel upwardly while the other hook is being pulled downwardly, the pulley block is simultaneously pulled downwardly by the cord attached between the hooks. This action, of course, pulls the eyelet downwardly against the upwardly biasing force of the spring attached to same. This results in the eyelet reaching a lowermost position as both hooks reach their respective lowermost positions.

For the eyelet to remain in the lower position, both the first and second hooks must be retained in their respective lowermost positions by their respective latches. In this manner, the individual griff bars continue to reciprocally move in a see-saw like motion above both hooks, but do not cause movement of the hooks, cord, pulley block, or eyelet. Conversely, for the eyelet to move to its upper position once again, one of the latches must disengage from one of the hooks as the associated griff bar is located in the lowermost position. In this manner, one of the hooks is released by the latch and allowed to travel upwardly with the griff bar to its upper position under the influence of the spring. This action results in the respective pulley block and eyelet moving upwardly to the original upper position. For the eyelet to remain in the upper position, the other latch must also release its respective hook, allowing the see-saw like motion of the hooks and cord to resume as initially described.

Many Jacquard weaving devices utilize electric solenoids to effect the selective retention of the hooks by the latches. In this type of design, an electric solenoid is mounted on the frame near each of the respective latches. Mounted on each latch is a material which can be magnetically influenced, or attracted, such as iron, when the solenoid is energized with electrical current. Generally, each latch is biased into a first, or latched, position. During operation, as a hook is moved into engagement with the respective latch, the hook pushes the latch into a second, or unlatched position, and in the direction of the solenoid such that the magnetically attractable material is pressed against or moved closely adjacent to the solenoid. In the situation where the solenoid is energized, the material is strongly attracted to the solenoid by the magnetic field. This in turn holds the latch in the unlatched position which prevents the latch from capturing and retaining the hook in the lowermost position as the hook moves upwardly and away from the respective latch.

On the other hand, if the solenoid is not energized, the bias of the latch causes the latch to move back to the latched position as the hook begins to move upwardly. In this scenario, before the hook completely disengages from the latch, the latch captures the hook, thereby retaining it in the lowermost position. If the hook is retained by the latch, the griff bar will disengage from the hook and continue moving upwardly while leaving the hook in its lowermost position. However, the subsequent downward movement of the griff bar will again move the hook against the respective latch in a manner which will cause movement of the latch to the unlatched position. This enables the hook to be subsequently released from the latch if the latch had been held in the unlatched position by the solenoid. In this manner, the weaving device selectively moves the eyelet by energizing and de-energizing the solenoids at given intervals which controls the movement of the hooks. Often a controller, such as a programmable logic computer, is utilized to control electrical current flow to the solenoids and related motor which propels the individual griff bars.

Commonly, a Jacquard weaving device consists of at least one row of eyelets which are configured as discussed above, with respective springs, pulley blocks, cords, hooks, latches and solenoids for each eyelet. Usually, the entire row of eyelets is served by a single pair of elongated griff bars. In this manner, each individual eyelet in the row may be moved from either the upper position to the lower position, or vice versa, or may remain in either the upper or lower position with each reciprocal stroke of the griff bars. Often, large Jacquard weaving devices consist of several such rows of similarly configured eyelets, each with its own set of griff bars. Thus, by moving the griff bars at repeating intervals, and selectively controlling the energization of the solenoids, the controller can cause any combination of eyelets to either move up or down, or remain in the upper or lower positions, with each shed change.

While Jacquard weaving machines of conventional design have been operated with varying degrees of success, there have been recognized shortcomings which have detracted from their usefulness. For example, a relatively large Jacquard weaving machine may consist of a dozen or more rows of eyelets, each row having up to thirty or more eyelets. Such a machine, having hundreds of individually movable eyelets, will have a complex, tightly packed mechanism comprised of interactive, precision components, including griff bars and related drive trains, hooks, latches, solenoids, cords, guides, and pulley blocks. Thus, a malfunction or failure of a single component in this complex, tightly packed mechanism necessitates a tedious and time-consuming disassembly of the machine in order to simply gain access to the failed or malfunctioning part for removal and replacement. This tedious disassembly process of the machine results in costly down-time of the weaving device, during which the operation of the device is temporarily halted.

Therefore, it has long been known that it would be desirable to provide a Jacquard weaving machine which achieves the benefits to be derived from similar prior art devices, but which avoids the detriments individually associated therefrom.

SUMMARY AND OBJECTIVES

In accordance with one aspect of the present invention, a weaving device comprises a weaving device frame; a plurality of eyelets movably mounted on the weaving device frame; and a frame module releasably borne by the weaving device frame and readily detachable from the respective eyelets, the frame module controlling the movement of the individual eyelets and forming a readily removable component of the weaving device.

Another aspect of the present invention relates to a frame module for use with a weaving device having a plurality of eyelets. The frame module controls the movement of the respective eyelets. The frame module comprising a frame releasably engageable with the weaving device and further includes a guide plate; a plurality of hooks movable borne by the frame and mounted on the weaving device; a plurality of latches mounted on the guide plate and movable between a latched position and an unlatched position; a plurality of solenoids releasably mounted on the frame, and wherein the respective solenoids facilitate the movement of the respective latches between the latched and unlatched positions.

A griff bar is movable borne on the frame and selectively engageable with respect to the hooks.

A drive member borne by the frame is provided for moving the griff bar selectively along the frame. The frame module forms a readily removable component of the weaving device.

Yet another aspect of the present invention relates to a frame module for use with a weaving device having a plurality of eyelets. The frame module controls movement of the respective eyelets. The frame module includes a weaving device frame and a plurality of biasing members mounted on the weaving device frame. Each of the eyelets is mounted on an individual biasing member. A plurality of first cords individually affixed on one of the eyelets, and which are further connected to the weaving device frame. A plurality of first pulley blocks are individually engageable with the respective first cords, and which are individually movable therewith.

A frame module is releasably mounted on the weaving device frame and further includes a guide plate mounted thereon. The frame module forms a readily removable component of the weaving device.

A plurality of second pulley blocks are releasably connected to each of the first pulley blocks. A plurality of hooks are selectively movable relative to the frame module between first and second positions. A plurality of second cords are mounted on the frame module and coact with the respective hooks. A plurality of latches are mounted on the guide plate and move between a latched position and an unlatched position.

A plurality of removable solenoids are mounted on the frame module, which facilitate movement of the respective latches between the latched and unlatched positions. A griff bar is movably borne on the frame module and is slidable along a reciprocal path of movement and wherein the griff bar to selectively engage the hooks.

A pair of sprockets are mounted on the frame module. A drive member disposed in force transmitting relation between the respective sprockets and the griff bar.

Another aspect of the present invention relates to a frame module for use with a weaving device having a plurality of eyelets. The frame module controls movement of the respective eyelets. The frame module also comprises a weaving device frame having a first end and an opposite second end.

A plurality of biasing members are mounted on the weaving device frame, and wherein each of the eyelets is mounted on an individual biasing member. A plurality of first cords are affixed one to each one of the eyelets, and which are further connected to the weaving device frame. A plurality of first pulley blocks are individually engageable with each of the respective first cords, and which are individually movable therewith. A frame module, releasably mounted on the weaving device frame, has opposite first and second ends, and a pair of spaced sidewalls, and wherein a channel is formed in the sidewalls adjacent to the second end thereof.

A griff track is provided on the spaced sidewalls. A guide plate is mounted between the respective sidewalls. A plurality of second pulley blocks are releasably connected to each of the first pulley blocks. A plurality of hooks are selectively movable relative to the frame module. Each of the hooks has a wheel rotatably mounted thereto, and wherein each of the hooks is selectively movable between first and second positions, and wherein, in the first position, the respective hooks are located near the first end of the frame module, and wherein, in the second position, the hooks are located near the second end of the frame module.

A plurality of second cords each have opposite first and second ends. The opposite ends of each of the second cords are mounted on the frame module. The pulley on each hook coacts with an associated one of the second cords.

A plurality of latches are movably mounted on the guide plate and is movable between a latched position and an unlatched position. Each latch is biased toward the latched position. Each of the hooks engages one of the latches when the hook is located in the second position. A plurality of solenoids are releasably mounted on a supporting substrate that is slidably engageable with the channel, which is formed in the sidewalls of the frame module. The respective solenoids have an energized and a de-energized state to facilitate movement of the respective latches between latched and unlatched positions. In the de-energized state, the respective hooks, upon engaging the individual latches, cause the respective latches to engage the individual hooks. In the energized state, the respective solenoids maintain the individual latches in the unlatched position.

A griff bar is movably borne on the frame module and is slidable along the griff track. The griff bar has a reciprocal path of movement, and is selectively engageable with selected ones of the hooks. When engaged with the hooks, the griff bar reciprocally moves the hooks, which are not held in the second position by the respective latches, from the second position of the hook, to the first position thereof.

First and second pairs of wheels, are rotatably mounted on one of the opposite sidewalls of the frame module. Each of the first and second pairs of wheels has an axis of rotation. The axes of rotation of the first and second pairs of wheels are substantially perpendicular to the sidewalls of the frame module. A drive member is disposed in force transmitting relation between the respective first and second pairs of wheels and the griff bar.

A further aspect of the present invention relates to a frame module for use with a weaving device having a plurality of eyelets, and wherein the frame module controls movement of the respective eyelets. The frame module comprises a weaving device frame have a first end and an opposite second end. A plurality of biasing members have a first and second ends. The first end of each biasing member is mounted on the first end of the weaving device frame. Each of the eyelets is individually mounted on the second end of a respective individual biasing member and is movable with respect to the weaving device frame. The eyelets are biased by the respective biasing members in the direction of the first end of the weaving device frame.

A plurality of first cords have opposite first and second ends, with the first end of each of the cords being affixed to a respective one of the eyelets, and the opposite second end of each of the cords is connected to the weaving device frame. A plurality of first pulley blocks are individually engageable with each of the respective first cords, and are movable with respect to the weaving device frame.

A frame module is detachably mounted on the weaving device frame, and has opposite first and second ends and a pair of spaced sidewalls. A channel is formed in the sidewalls adjacent to the second end thereof. A griff track is provided on the spaced sidewalls. The frame module is readily detachable from the respective eyelets. A plurality of second pulley blocks are releasably connected one to each one of the first pulley blocks. A plurality of hooks are selectively movable relative to the frame module, and each of the hooks has a pulley wheel rotatably mounted thereto. Each of the hooks is selectively movable between a first and second position. In the first position the respective hooks are located near the first end of the frame module, and in the second position, the hooks are located near the second end of the frame module.

A plurality of second cords each having opposite first and second ends are mounted on the frame module. The pulley wheel of each hook is engaged by a respective one of the second cords. A plurality of latches are movably mounted on the guide plate, each latch being movable between a latched position and an unlatched position.

Each latch is biased toward the latched position. Each of the hooks engages an associated one of the latches when the hook is located in the second position, and the latch is located in the latched position. A plurality of solenoids mounted on a supporting substrate that is slidably engageable within the channel which is formed in the sidewalls of the frame module. The respective solenoids have an energized and a de-energized state to facilitate movement of the respective latches between the latched and unlatched positions. In the de-energized state, the respective hooks, upon engaging the individual latches, cause the respective latches to engage the individual hooks. In the energized state, the respective solenoids maintain the individual hooks in the unlatched position.

A griff bar is selectively movably borne on the frame module and is slidable along the griff track. The griff bar has a reciprocal path of movement to selectively engage the hooks. When engaged with the hooks, the griff bar reciprocally moves those hooks which are not held in the second position by the respective latches, from the second position to the first position.

First and second pairs of wheels, are rotatably mounted on the opposite sidewalls of the frame module. A drive member is disposed in force transmitting relation between the respective first and second pairs of wheels and the griff bar.

A still further aspect of the invention relates to a frame module for use with a weaving device having a plurality of eyelets, and wherein the frame module controls movement of the respective eyelets. The frame module comprises a module frame releasably engageable with the weaving device and is mountable to the weaving device. A plurality of hooks are movably borne by the module frame and configured for releasable attachment to the eyelets. A plurality of latches are mounted on the module frame, each being moveable between a latched position and an unlatched position. A plurality of solenoids are releasably mounted on the module frame to facilitate movement of the respective latches between the latched and unlatched positions. A griff bar is movably borne on the module frame and engages selected hooks. The frame module forms a readily removable component of the weaving device.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
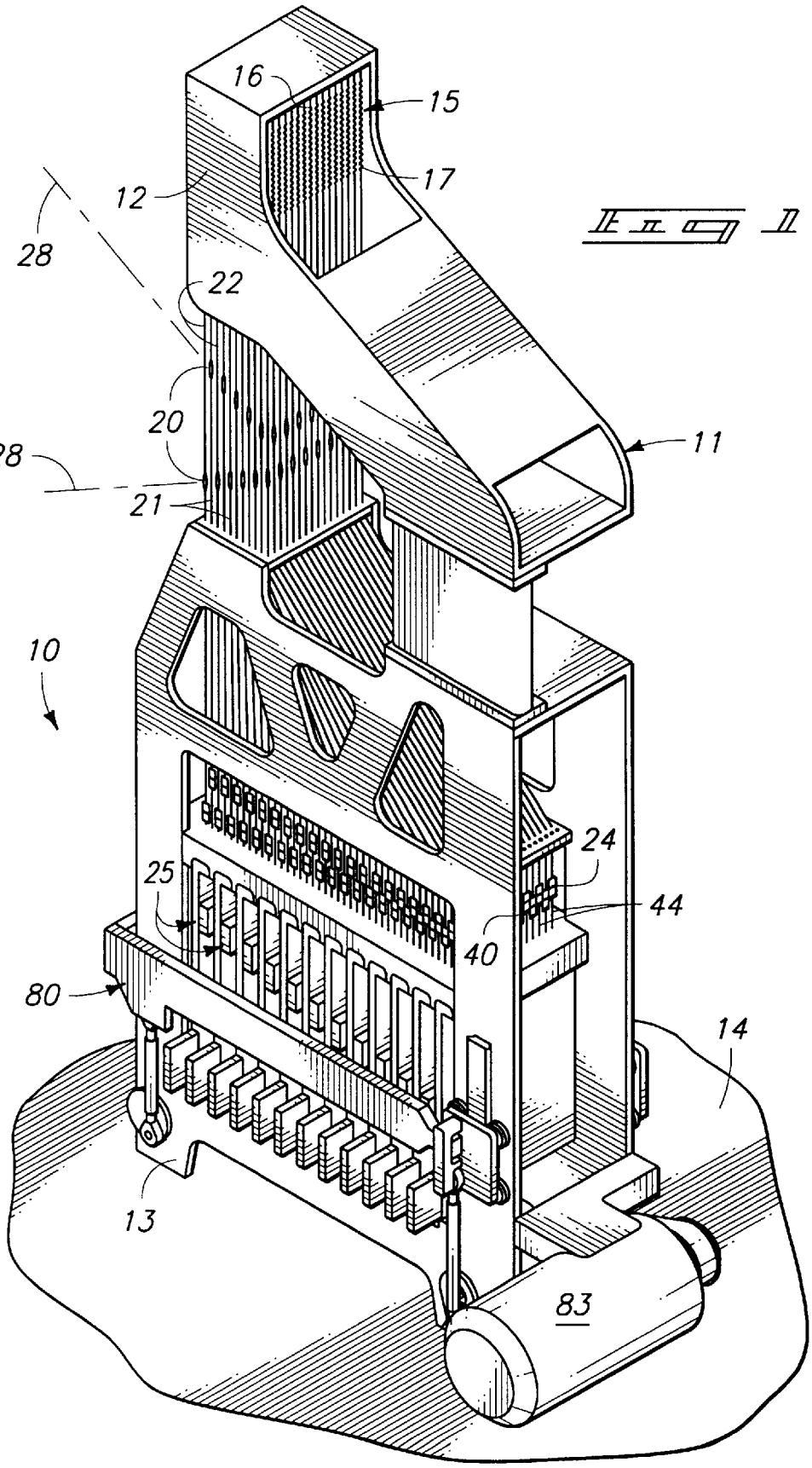
FIG. 1 is a perspective view or a weaving device incorporating preferred aspects of the present invention.

The apparatus of the subject invention is generally indicated by the numeral 10 in the accompanying drawings. As shown in FIG. 1, the apparatus 10 may be provided in combination with a weaving device which includes a frame 11 with a first end 12 and an opposite second end 13. The weaving device frame 11 rests on the surface of the earth 14.

Figure 6:
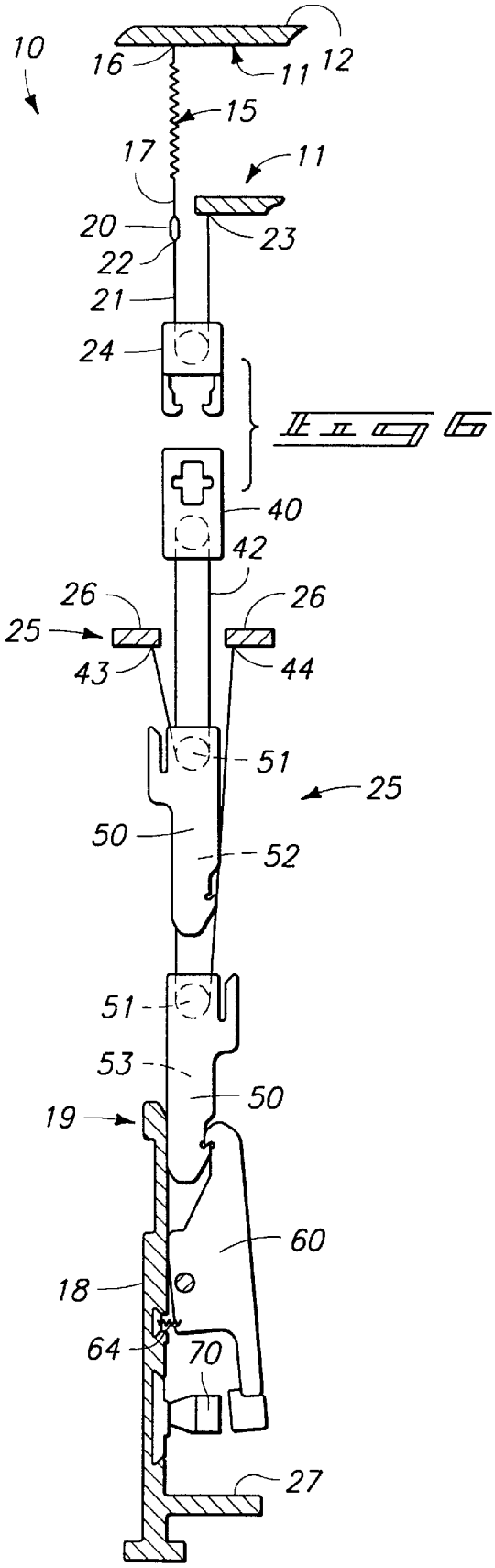
FIG. 6 is a diagrammatic sectioned view illustrating preferred interconnections between elements of a preferred frame module and eyelets of the weaving device.

As can be seen in FIG. 1 and more clearly in FIG. 6 a plurality of biasing members 15 each having a first end 16 and a second end 17 are individually mounted on the first end 12 of the weaving device frame 11. As also seen in FIG. 1 an eyelet 20 is individually mounted on the second end 17 of each of the biasing members 15, and is movable with respect to the weaving device frame 11. Each of the eyelets 20 is biased by the respective biasing members 15 in the direction of the first end 12 of the weaving device frame 11.

As also shown in diagrammatic form by FIG. 6, the apparatus 10 includes a plurality of first cords 21 each having a first end 22 and an opposite second end 23. The first end 22 of each first cord 21 is affixed to one of the eyelets 20, and the opposite second end 23 is connected to the weaving device frame 11. As further shown in FIGS. 2 and 6, a plurality of first pulley blocks 24 are individually engaged with each of the respective first cords 21, and are movable with respect to the weaving device frame 11.

Figure 2:
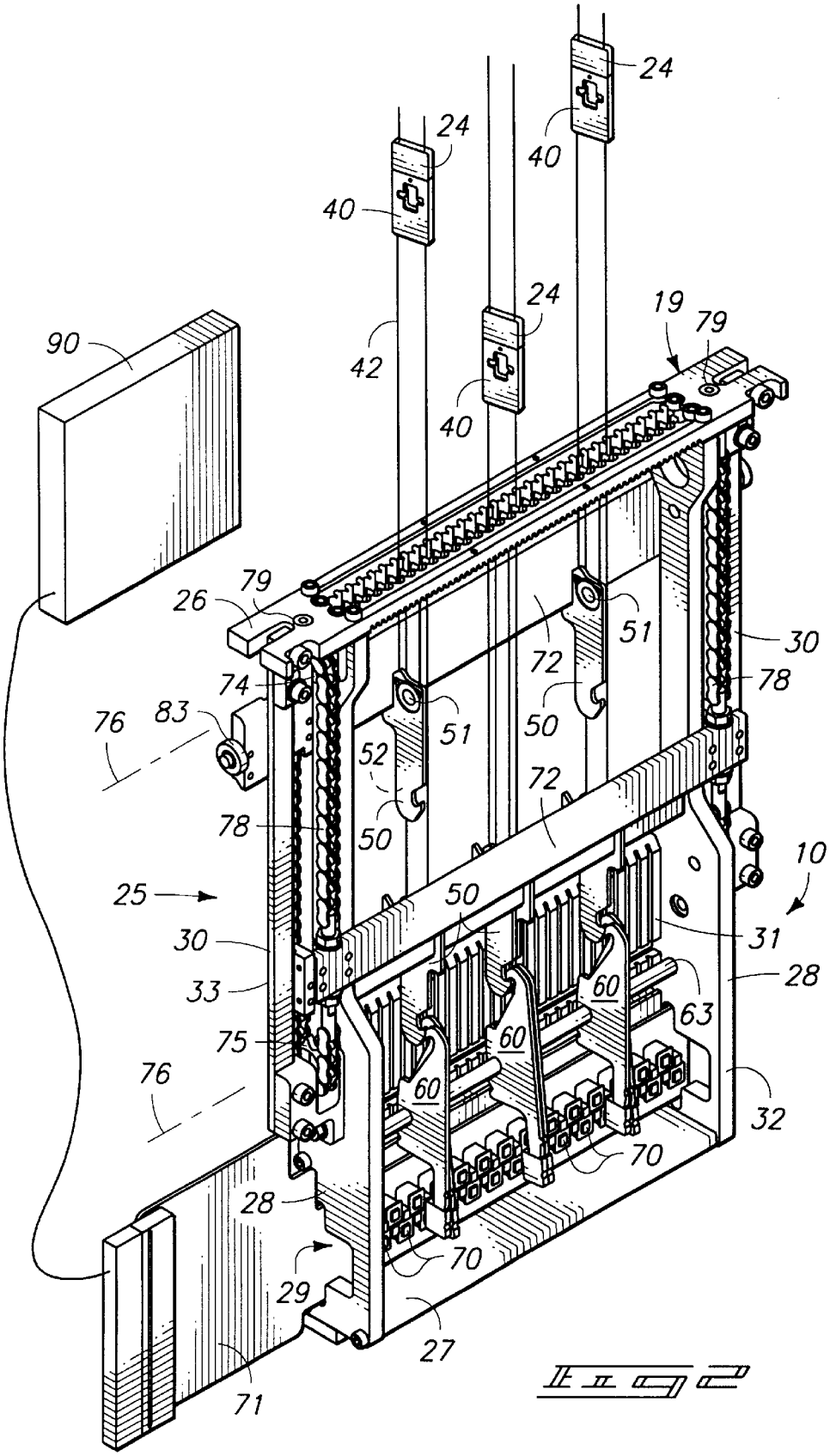
FIG. 2 is a fragmented perspective view of a preferred frame module.

Now referring to FIG. 1 and more particularly to FIG. 2, at least one and preferably a plurality of substantially identical frame modules 25 are detachably mounted on the weaving device frame 11. Referring to FIG. 2, each frame module has generally rectangular module frame 19 with a first end 26 and an opposite second end 27, and a pair of spaced sidewalls generally indicated by the numeral 28. As further shown in FIGS. 2 and 5, a channel 29 is formed in each of the sidewalls 28 adjacent to the second end 27 of the frame module 25 for releasably receiving a solenoid substrate 71.

Still referring to FIG. 2, a pair of griff tracks indicated by the numeral 30 are provided on each of the frame modules 25, preferably along the spaced sidewalls 28. In preferred forms, a guide plate 31 is mounted between the respective sidewalls 28. As also shown, the frame module 25 has a first side 32 and a second side 33.

As shown in FIGS. 2 and 6, each module includes a second pulley block 40 for releasable connection to each of the first pulley blocks 24. A plurality of second cords 42, each having a first end 43 and an opposite second end 44 are mounted to each of the frame modules 25. A plurality of hooks 50 are mounted within and are connected to the second cords 42 and are selectively movable relative to the respective frame modules 25.

Each of the hooks 50 preferably has a rotatable pulley wheel 51. As further shown in FIGS. 2, 5, and 6, and most clearly by the schematic view in FIG. 7, the pulley wheels 51 on pairs of hooks 50 are engaged by one of the second cords 42 between the first end 43 and second end 44. Each of the hooks 50 is selectively movable between a first position indicated by the numeral 52 and a second position indicated by numeral 53. As can be seen in FIG. 6, the first position 52 of the respective hooks 50 is located near the first end 26 of the frame module 25. Similarly, the second position 53 of the hooks 50 is located near the second end 27 of the frame module 25.

Figure 7:
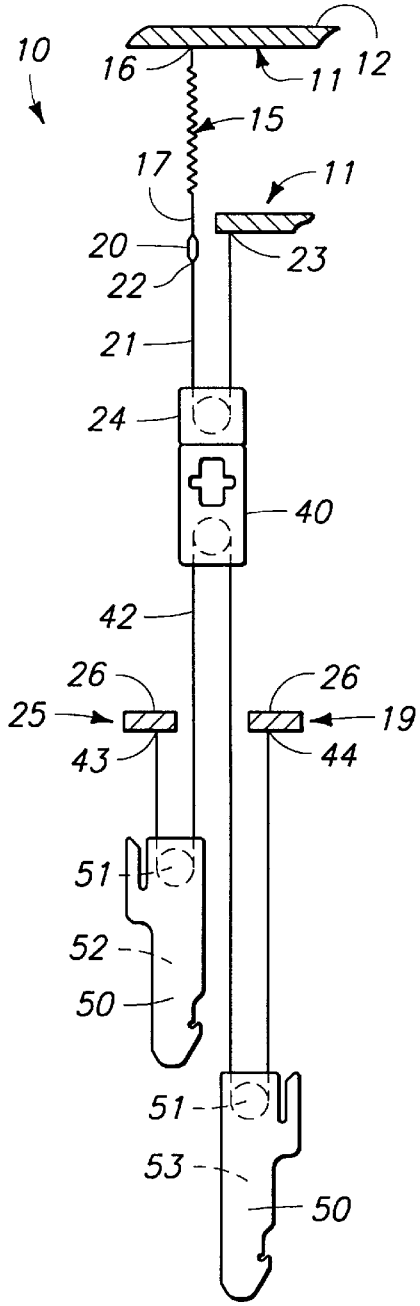
FIG. 7 is a schematic view illustrating cord and hook connections within a frame module.

FIG. 7 is in schematic form to facilitate clear understanding of the connection between the second cords 42, pulley wheels 51 (on hooks 50), and second pulley blocks 40. As shown, the first end 43 is attached to the module, preferably at the first end 26. The cord extends within the module downward to engage one of the pulleys 51, then upwardly over the pulley within the second pulley block 40, thence downwardly to engage the other pulley 51 of another hook and then upwardly to connect at second end 44 to the first end of the module.

A distinct mechanical relationship is provided with respect to movement of the hooks and responsive movement of the associated eyelet 20. One unit of linear movement of either hook 50 will result in two units of linear movement of the associated eyelet 20. Thus a small movement of a hook is twice amplified in resulting movement of the associated eyelet.

The above is a distinct advantage over prior shed changing mechanisms where the ratio of hook to eyelet movement was one-to-one. Now, the hooks need move only half as far (as the prior hooks) to achieve the same eyelet motion. The result is a much faster and less bulky shed changing apparatus.

Figure 5:
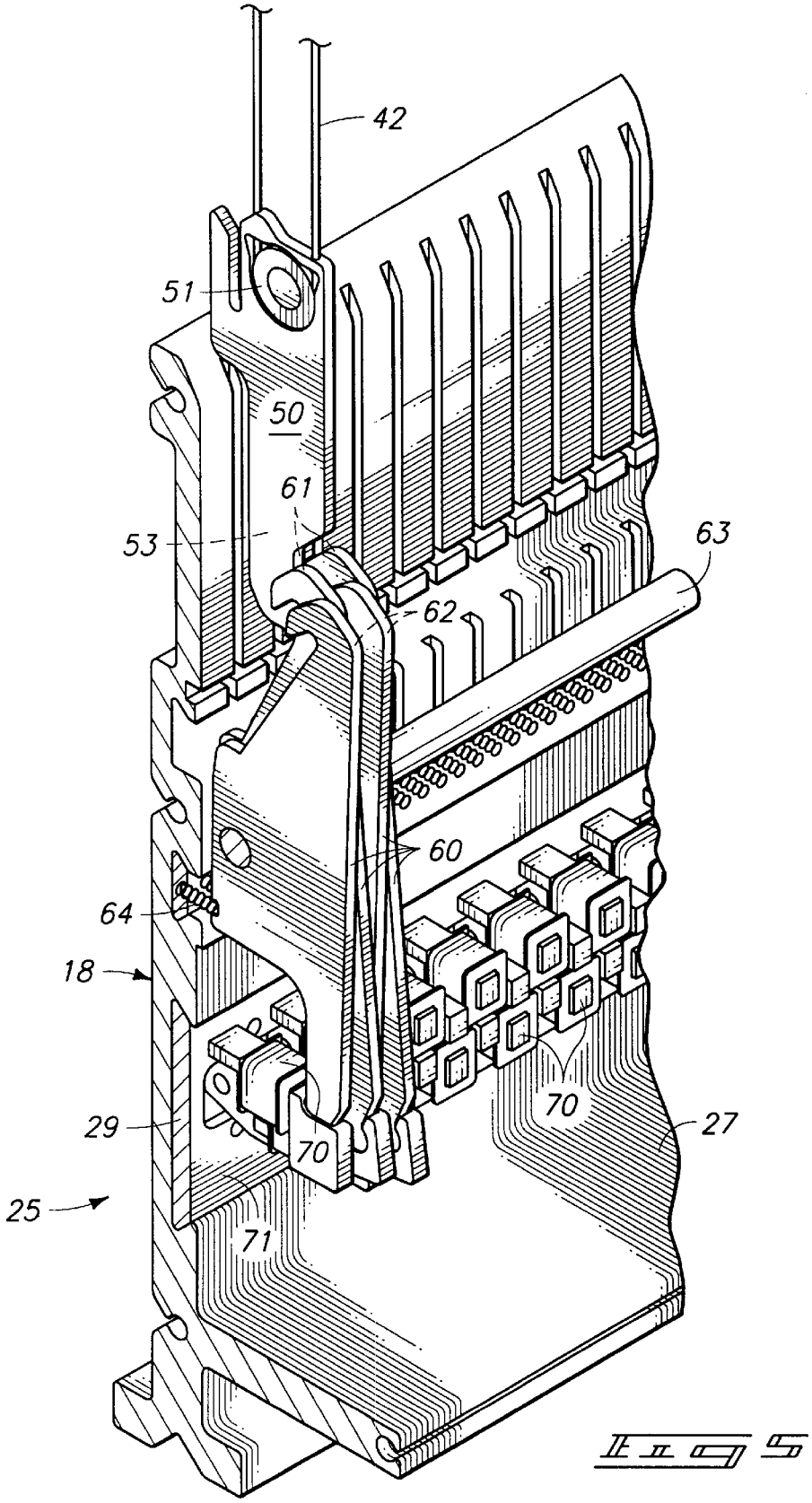
FIG. 5 is an enlarged fragmented perspective view of preferred latch and hook mechanisms.

Now referring to FIGS. 2 and 5, a preferred form of the apparatus 10 includes a plurality of latches 60 which are movably mounted on a pivot shaft 63 that extends between the side walls 28. Now referring to FIG. 5, each latch 60 is movable between a latched position indicated by the numeral 61 and an unlatched position indicated by the numeral 62. Each latch 60 is biased toward the latched position 61, preferably by a resilient member 64. Each of the hooks 50 will engage a respective one of the latches 60 and be retained by the latch when the hook 50 is located in the second position 53, and the latch 60 is located in the latched position 61.

As briefly noted above, the apparatus 10 also includes a plurality of solenoids 70 which are mounted on supporting substrates 71. As shown in FIG. 5, each supporting substrate 71 is slidably engageable with the channel 29 which is formed through the sidewalls 28 of the associated frame module 25. The solenoids 70 each have an energized and a de-energized state, and facilitate the movement of the respective latches 60 between the latched positions 61 and the unlatched positions 62.

When a given solenoid 70 is in the de-energized state, the given solenoid does not maintain the respective latch 60 in the unlatched position and the respective hook 50 upon engaging the latch 60, causes the latch 60 to engage and retain the respective hook 50 in the second position 53. Conversely, a given solenoid 70 in the energized state maintains the respective latch 60 in the unlatched position 62 wherein the respective hook 50 is not retained in the second position 53.

Figure 4:
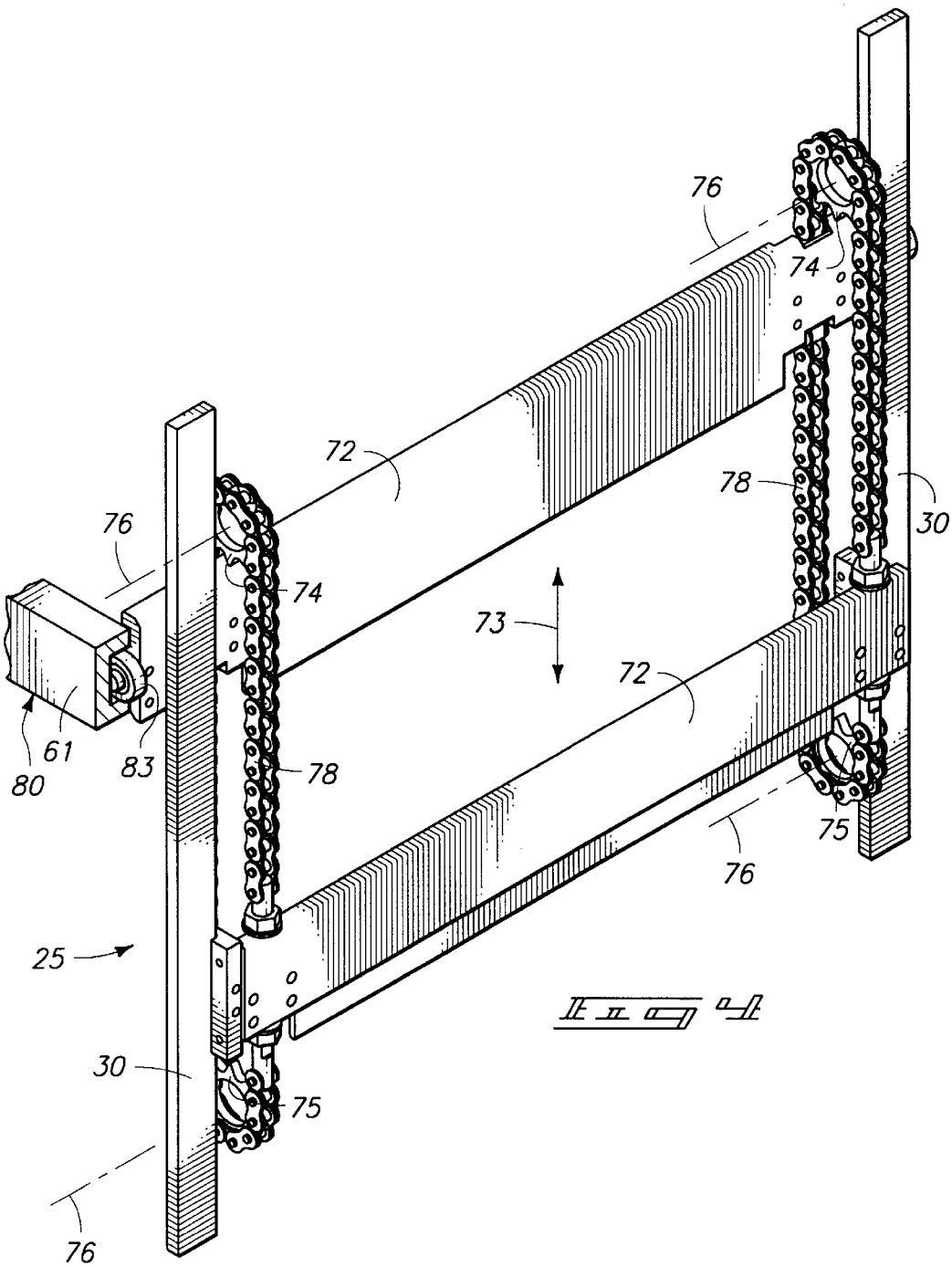
FIG. 4 is a fragmented perspective view of griff bars and connecting drive members of a preferred frame module.

Referring to FIG. 2 and the simplified diagram of FIG. 4, the apparatus 10 further comprises a pair of griff bars 72 which are each selectively movably borne on each frame module 25. Each griff bar 72 is slidable along the associated griff tracks 30 in a reciprocal path of movement 73. As shown in FIG. 2, each griff bar 72 is selectively engageable with a predetermined number of the hooks 50, and when engaged with the hooks 50 the griff bar 72 reciprocally moves those hooks 50 which are not held in the second position 53 by the respective latches 60, from the second position 53 of the hook 50, to the first position 52 of the hook 50.

FIG. 2 further indicates first and second pairs of wheels that are provided preferably in the form of upper and lower sprockets 74, 75 respectively, which are rotatably mounted on the module frame, with the upper sprockets 74 adjacent the first module end 26 and the lower sprockets 75 are adjacent the second module end 27.

Each of the first and second pairs of sprockets 74, 75 has an axis of rotation 76 which is substantially perpendicular to the sidewalls 28 of the frame module 25. Referring to FIG. 1 and particularly to FIG. 4, a drive member 78 in the form of a belt or chain is disposed in forced transmitting relation between the respective first and second pairs of sprockets 74, 75, and the pair of griff bars 72. As can be noted by a study of FIG. 4, the configuration of the drive member 78 and the first and second pairs of sprockets 74 and 75 in relation to the griff bars 72 is such that the direction of movement of one griff bar 72 is opposite to the direction of movement of the griff bar 72 of a pair.

The lower sprockets 75 rotate about axis 76 which is fixed relative to the module frame 19. The lower sprockets thus function as idlers. However, the upper sprockets 74 function as drive sprockets, responsive to downward thrust against alternate sides of the chains. The upper sprockets are mounted by adjustors 79 (FIG. 2) to the module frame 19, so the axis for sprockets 74 is adjustable toward and away from the bottom sprockets. Such adjustment serves to selectively tension the drive members 78, and the relative positions of the griff bars on opposite sides of the module frame.

Figure 3:
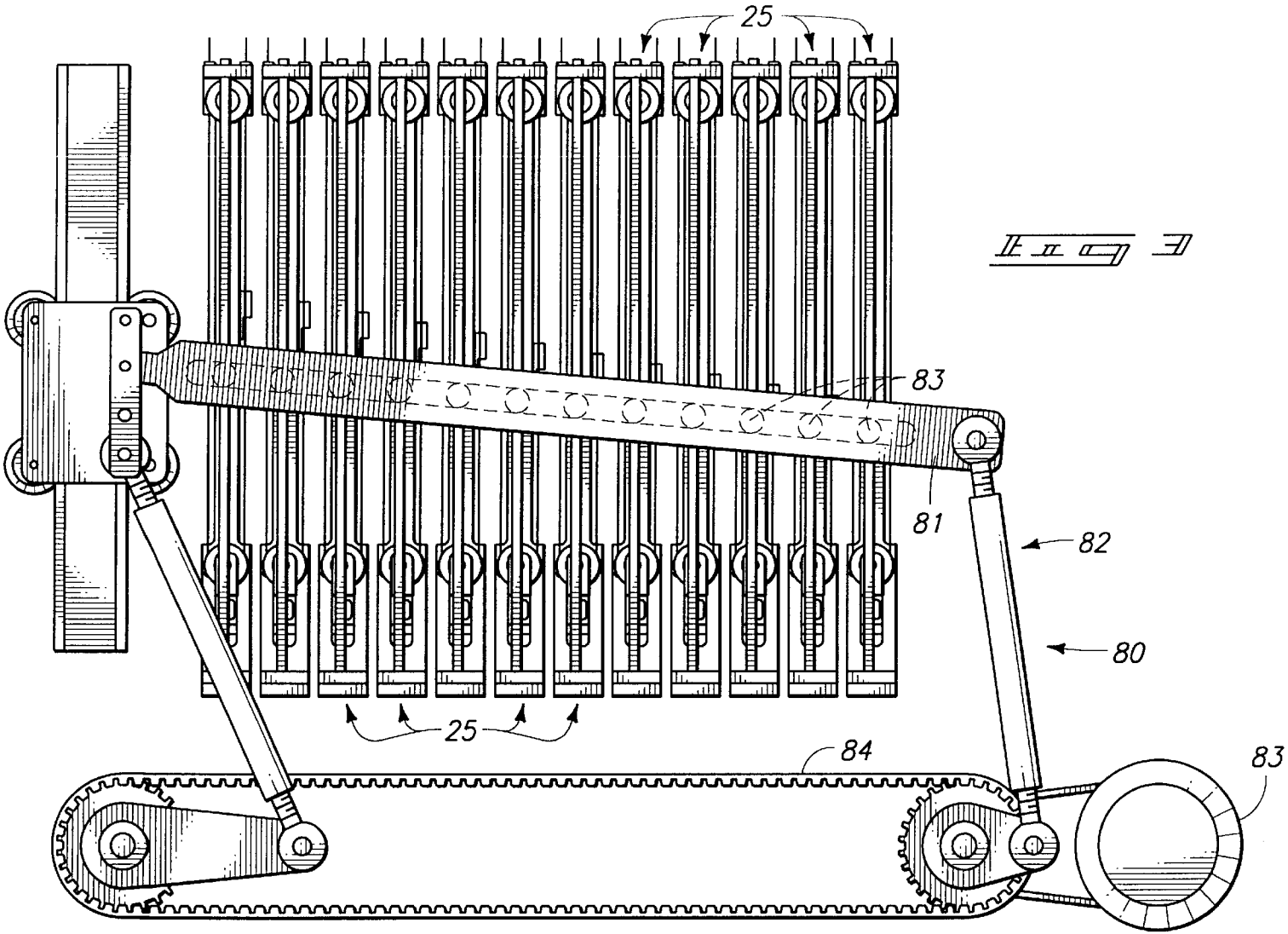
FIG. 3 is a fragmented rear elevation view illustrating interconnection of several frame modules in a weaving frame and an associated griff bar actuator.

As shown in FIGS. 1, 3, and 4, a preferred apparatus 10 further includes an actuator 80 which is releasably disposed in force transmitting relation to one of the pair of griff bars 72, and which transmits motive force to the griff bar 72.

In preferred forms, the actuator 80 is comprised of a bar 81 that is operated by a bellcrank linkage 82 connected at ends of the bar 81 to move the bar in a selected rocking motion. An appropriate motor 83 and belt or chain drive 84 may be provided to rotate the bell cranks and thereby produce elevational reciprocating movement of the bar 81.

The actuator 80 is slotted longitudinally to receive rollers 83 that are mounted to one griff bar 72 of each griff bar pair. Motion of the bar 81 is thus transmitted to the rollers 83 which, in response, cause the griff bars 72 to move in the reciprocating translational path 73.

FIG. 2 indicates a controller 90 releasably electrically coupled to each of the solenoids 70, and which selectively energizes each of the individual solenoids 70. A controller 90 may be provided for each of the frame modules supplied in a weaving device.

Further study will indicate that solenoids 70, the latches 60 and hooks 50 are located on the first side 32 of the frame module 25. Also indicated by a further study, the position of each of the griff bars 72 with respect to the drive member 78 may be adjusted by changing the griff bar positions along respective sides of the drive member 78. A yet further study will indicate that the releasable connection between the first pulley blocks 24 and the second pulley blocks 40 allows the frame module 25 to be readily and individually detachable from the respective eyelets 20 and the remainder of the weaving device.

OPERATION

The operation of the described embodiments of the present are believed to be readily apparent and briefly summarized at this point.

As earlier discussed, the apparatus 10 of the subject invention comprises a weaving device frame 11 which rests on the surface of the earth 12. A plurality of eyelets 20 are movably mounted on the weaving device frame 11 through a plurality of biasing members 15 which resiliently connect the eyelets 20 to the weaving device frame 11. At least one and in many instances several frame module 25 are releasably borne by the weaving device frame 11 to control movement of the individual eyelets 20 by selectively transmitting a motive force to each of the eyelets 20. Each frame module 25 is readily detachable from the respective eyelets 20 and the weaving device frame 11 and forms a readily removable component of the weaving device apparatus 10.

Each frame module 25 includes a module frame 19 which is releasably engageable with the weaving device apparatus 10, and which includes a pair of sidewalls 28, a guide plate 31, a plurality of hooks 50 which are movably borne by the frame. A plurality of latches 60 on the module frame 19 are each movable between a latched position 61 and an unlatched position 62. A plurality of solenoids 70 are releasably mounted on the frame 19 by way of a supporting substrate 71. The solenoids 70 facilitate movement of the respective latches 60 between the latched position 61 and the unlatched position 62. The frame module 25 further comprises a pair of griff bars 72 which are movably borne on the frame 19 and which are selectively engageable with respect to the hooks 50. Each frame module 25 further includes a drive member 78 borne by the frame 19 for moving the griff bars 72 selectively along the frame 19.

Further included in the frame module 25 is a plurality of second cords 42 which are mounted on the frame module and coact with respective pairs of hooks 50. Also included in the frame module is a plurality of second pulley blocks 40 which are engaged individually to each second cord 42 between the respective hooks 50 which coact therewith.

Included in the weaving device 10 is a plurality of first cords 21 each having a first end 22 which is connected to the weaving device apparatus 10, and a second end 23 which is individually affixed on one of the eyelets 20. The weaving device apparatus 10 further comprises a plurality of first pulley blocks 24 which are individually engaged with the respective first cords 21 and which are individually movable therewith. The second pulley blocks 40 of the frame modules 25 are releasably connected to respective first pulley blocks 24 of the weaving device, and thereby operably connect the frame module to eyelets 20.

The actuator 80 produces a motive force and is operably coupled in releasable forced transmitting relation to the griff bars 72. The motive force produced by the actuator 80 and transmitted to the griff bars 72, causes the griff bars 72 to reciprocate along a given path of movement 73. The griff bars 72 reciprocating along the path of movement 73 engage selected ones of the hooks 50 which are selectively movable relative to the frame module 25 between a first position 52 and a second position 53. Movement of the hooks causes corresponding amplified movement of the associated eyelets 20 to complete a shed change.

A given hook 50 moving to the second position 53 will engage a respective latch 60. The hook 50 moves the latch 60 against yieldable resistance offered by the associated resilient member 64 and shifts the latch 60 from the latched position 61 to the unlatched position 62. In the unlatched position 62, the latch 60 engages a respective solenoid 70.

A controller 90 is electrically coupled to each of the solenoids 70, and selectively supplies each solenoid 70 with electrical current. When energized with electrical current, a given solenoid 70 produces a magnetic field, which influences a given latch 60, so as to retain the given latch 60 in the unlatched position 62. In the absence of the magnetic field produced by the solenoid 70, the latch 60 will return to the latched position by operation of the resilient member 64, as the respective hook 50 begins to move toward the first position 52.

As the hook 50 begins to move from the second position 53 toward the first position 52, the latch 60 simultaneously moves from the unlatched position 62 to the latched position 61, whereupon the latch retains the hook in the second position 53. When the hook 50 is retained by the latch 60 in the second position 53, the respective griff bar 72 continues to move upward, disengaging the respective hook 50 and continuing its movement upward along the path of movement 73.

As one of the pair of griff bars 72 moves upwardly, leaving selected hooks 50 retained by the latches 60 that are presently in the second position 53, the other griff bar 72 of the pair will simultaneously move downward along the respective path of movement 73 and pull other hooks 50 downward toward respective latches 60. As this occurs, the second cords 42 pull the second pulley blocks 40 downward which in turn, pull the respective first pulley blocks 24 downward which pull the respective eyelets 20 downward as well, but twice the distance moved by the hooks 50. A selected shed change is thus accomplished.

If a malfunction occurs in any one of the frame modules 25, or components thereof, the associate second pulley blocks 40 are disconnected from the first pulley blocks 24 and the actuator 80 and controllers 90 are uncoupled from the griff bars 72 and solenoids 70, respectively. The entire frame module 25 may now be pulled from the weaving device frame 11, leaving the remaining modules operable and connected to the weaving device. An functional frame module 25 may now be installed into the weaving device frame 11, whereupon the second pulley blocks 40 are connected to the associated first pulley blocks 24 and the actuator 80 and controllers 90 are coupled to the griff bars 72 and solenoids 70 respectively, rendering the weaving device 10 fully operational once more. This process is easily and quickly accomplished without affecting operation of the remaining functional frame modules or the weaving device.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A weaving device, comprising:

a weaving device frame;

a plurality of eyelets movably mounted on the weaving device frame; and a frame module releasably borne by the weaving device frame and readily detachable from the respective eyelets, the frame module controlling the movement of the individual eyelets and forming a readily removable component of the weaving device.

2. A weaving device as claimed in claim 1, and further comprising a plurality of biasing members mounted on the weaving device frame, and wherein the eyelets are mounted on the biasing members.

3. A weaving device as claimed in claim 1, and further comprising a plurality of first cords individually affixed on one of the eyelets, and which are further connected to the weaving device frame.

4. A weaving device as claimed in claim 3, and further comprising a plurality of first pulley blocks individually engageable with the respective first cords, and which are individually movable therewith.

5. A weaving device as claimed in claim 4, and further comprising a plurality of second pulley blocks releasably connected to the first pulley blocks.

6. A weaving device as claimed in claim 1, and further comprising a plurality of hooks selectively movable relative to the frame module between a first and second position.

7. A weaving device as claimed in claim 6, and further comprising a plurality of second cords mounted on the frame module and coacting with the respective hooks.

8. A weaving device as claimed in claim 1, and further comprising a plurality of latches mounted on the frame module and that are movable between a latched positions and unlatched positions.

9. A weaving device as claimed in claim 8, and further comprising a plurality of solenoids mounted on the frame module and which facilitate the selective retention of the respective latches in the unlatched positions.

10. A weaving device as claimed in claim 6, and further comprising a griff bar movably borne on the frame module and slidable along a reciprocal path of movement, and wherein the griff bar selectively engages each of the hooks.

11. A weaving device as claimed in claim 10, and further comprising a pair of wheels mounted on the frame module.

12. A weaving device as claimed in claim 11, wherein the pair of wheels include an upper wheel and a lower wheel; and further comprising a drive member disposed in force transmitting relation between the respective wheels and the griff bar; and wherein the upper wheel is adjustable toward and away from the lower wheel.

13. A weaving device as claimed in claim 9, and wherein the solenoids are removable from the frame module.

14. A frame module for use with a weaving device having a plurality of eyelets, and wherein the frame module controls the movement of the respective eyelets, the frame module comprising:

a frame releasably engageable with the weaving device;

a plurality of hooks movably borne by the frame, and mounted on the weaving device;

a plurality of latches mounted on the frame and moveable thereon between latched and unlatched positions;

a plurality of solenoids releasably mounted on the frame, and wherein the respective solenoids facilitate movement of the respective latches;

a griff bar movably borne on the frame and selectively engageable with respect to the hooks; and a drive assembly borne by the frame for moving the griff bar selectively along the frame, and wherein the frame module forms a readily removable component of the weaving device.

15. A frame module as claimed in claim 14, wherein the weaving device further includes a plurality of first cords affixed to the eyelets and a plurality of first pulley blocks individually engageable with the respective first cords, and which are individually movable therewith; and wherein the frame module is further comprised of a plurality of second pulley blocks releasably connected to each of the first pulley blocks.

16. A frame module as claimed in claim 15, and wherein hooks are movably borne on the frame and are selectively movable relative to the frame module between a first position and a second position.

17. A frame module as claimed in claim 16, and further comprising a plurality of second cords mounted on the frame module and coacting with the respective hooks.

18. A frame module as claimed in claim 17, and wherein the griff bar is reciprocally moveable relative to the frame.

19. A frame module as claimed in claim 18, and further comprising a pair of wheels mounted on the frame.

20. A frame module as claimed in claim 19, and further comprising a drive member disposed in force transmitting relation between the respective wheels and the griff bar.

21. A frame module as claimed in claim 17 wherein two hooks are mounted to each of said second cords.

22. A frame module as claimed in claim 17 wherein each hook includes a pulley and wherein each of the second cords is trained over the pulleys of two hooks.

23. A frame module as claimed in claim 14 wherein the hooks are releasably connected to the eyelets such that movement of the hooks in a prescribed direction through one unit of distance causes a movement of the eyelets in the prescribed direction over a multiple of said one unit of distance.

24. A weaving device, comprising:

a plurality of eyelets;

a weaving device frame;

a plurality of biasing members mounted on the weaving device frame, and wherein each of the eyelets are mounted on the individual biasing members;

a plurality of first cords affixed on the eyelets, and which are further connected to the weaving device frame;

a plurality of first pulley blocks individually engageable with the respective first cords, and which are individually moveable therewith;

a frame module releasably mounted on the weaving device frame and forming a readily removable component of the weaving device;

a plurality of second pulley blocks releasably connected to each of the first pulley blocks;

a plurality of hooks selectively moveable relative to the frame module between a first and second position;

a plurality of second cords mounted on the frame module and coacting with the respective hooks and second pulley blocks;

a plurality of latches mounted on the frame module and moveable between a latched position and an unlatched position;

a plurality of removable solenoids mounted on the frame module and which facilitate the movement of the respective latches;

a griff bar movably borne on the frame module and movable along a reciprocal path of movement and wherein the griff bar selectively engages the hooks; and a drive member disposed in force transmitting relation between the respective frame module and the griff bar.

25. A weaving device as claimed in claim 24, and wherein the frame module has opposite first and second ends, and spaced sidewalls, and wherein a channel is formed in the sidewalls adjacent to the second end thereof, and wherein a griff track is disposed on the spaced sidewalls.

26. A weaving device as claimed in claim 24, and wherein each of the hooks has a pulley wheel rotatably mounted thereto in coacting relation with one of the second pulley blocks.

27. A weaving device as claimed in claim 24, and wherein each of the hooks includes a pulley wheel; and wherein the hooks are mounted in pairs by the pulley wheels thereon to each one of the second cords.

28. A weaving device as claimed in claim 27, and wherein each of the second cords have opposite first and second ends, and wherein the first and second ends of each of the second cords are mounted on the frame module.

29. A weaving device as claimed in claim 24, and wherein each latch is biased toward the latched position, and wherein the hooks engage the latches when the hooks are located in the second position, and are configured to move the latches to the unlatched positions.

30. A weaving device as claimed in claim 29, and wherein the solenoids are mounted on a supporting substrate, and wherein the supporting substrate is slidably engageable within a channel which is formed in the frame module, and wherein the respective solenoids have an energized state and a de-energized state, and wherein, in the energized state, the respective solenoids maintain the individual hooks in the unlatched positions.

31. A frame module as claimed in claim 30, and wherein, when the griff bar engages the hooks, the griff bar reciprocally moves those hooks, which are not held in the second position by the respective latches, from the second position of the hook to the first position thereof.

32. A frame module as claimed in claim 31, and further comprising first and second pairs of wheels, and wherein each of the pairs of wheels are rotatably mounted on one of the opposite sidewalls of the frame module and are connected to the drive member.

33. A frame module as claimed in claim 32, and wherein the frame module includes opposed sidewalls; and wherein each of the first and second pairs of wheels have an axis of rotation, and wherein the axes of rotation of the first and second pairs of wheels are substantially perpendicular to the sidewalls of the frame module.

34. A weaving device, comprising:

a plurality of eyelets;

a weaving device frame having a first end and an opposite second end;

a plurality of biasing members mounted on the weaving device frame, and wherein the eyelets are mounted on the biasing members;

a plurality of first cords affixed individually to the eyelets, and which are further connected to the weaving device frame;

a plurality of first pulley blocks which are engageable individually with the respective first cords, and which are individually moveable therewith;

a frame module releasably mounted on the weaving device frame, and wherein the frame module has opposite first and seconds ends, and a pair of spaced sidewalls, and wherein a channel is formed in the sidewalls adjacent the second end thereof, and wherein a griff track is provided on the spaced sidewalls;

a plurality of second pulley blocks, releasably connected to each of the first pulley blocks;

a plurality of hooks selectively moveable relative to the frame module, and wherein each of the hooks has a pulley wheel rotatably mounted thereto, and wherein each of the hooks is selectively movable between a first and second position, and wherein, in the first position, the respective hooks are located near the first end of the frame module, and wherein, in the second position, the hooks are located near the second end of the frame module;

a plurality of second cords each having opposite first and second ends, and wherein opposite ends of each of the second cords are mounted on the frame module;

wherein the pulley wheels of pairs of the hooks coacts with each of the second cords;

wherein the second cords coact individually with the second pulley blocks;

a plurality of latches movably mounted on the frame module, and wherein each latch is moveable between a latched position and an unlatched position, and wherein each latch is biased toward the latched position, and wherein individual hooks are operable to engage one of the latches when the hooks are located in the second positions;

wherein the individual latches are operable to retain selected hooks in the second position;

a plurality of solenoids releasably mounted on a supporting substrate, and wherein the supporting substrate is slidably engageable within the channel, and wherein the respective solenoids have an energized and a de-energized state, and wherein, in the energized state, the respective solenoids maintain selected individual hooks in the unlatched positions;

a griff bar movably borne on the frame module and movable along the griff track, and wherein the griff bar has a reciprocal path of movement, and wherein the griff bar is selectively engageable with the hooks, and wherein, when engaged with the hooks the griff bar reciprocally moves hooks which are not held in the second position by the respective latches, from the second positions of the hooks, to the first positions thereof;

first and second pairs of wheels, each pair of wheels rotatably mounted on one of the opposite sidewalls of the frame module, and wherein each of the first and second pairs of wheels have an axis of rotation, and wherein the axes of rotation of the first and second pairs of wheels are substantially perpendicular to the sidewalls of the frame module; and a drive member disposed in force transmitting relation between the respective first and second wheel and the griff bar.

35. A weaving device as claimed in claim 34, and wherein each biasing member has a first end and a second end, and wherein the first end of each of the biasing members is mounted on the first end of the weaving device frame, and wherein each of the eyelets is individually mounted on the second end of each of the biasing members and is movable with respect to the weaving device frame, and wherein each of the eyelets is biased by the respective biasing members in the direction of the first end of the weaving device frame.

36. A frame module as claimed in claim 35, wherein the first ends of the first cords are individually affixed on the eyelets, and wherein the opposite second ends of the first cords are individually connected to the weaving device frame.

37. A frame module as claimed in claim 36, wherein the frame module is detachable from the respective eyelets.

38. A weaving device, comprising:

a plurality of eyelets;

a weaving device frame having a first end and an opposite second end;

a plurality of biasing members, each biasing member having a first end and a second end, and wherein the first end of each of the biasing members is mounted on the first end of the weaving device frame, and wherein the eyelets are individually mounted on the second ends of individual biasing members, and are movable with respect to the weaving device frame, and wherein each of the eyelets is biased by the respective biasing members in the direction of the first end of the weaving device frame;

a plurality of first cords having opposite first and second ends, and wherein the first ends of the first cords are individually affixed to individual ones of the eyelets, and wherein the opposite second end of each of the first cords is connected to the weaving device frame;

a plurality of first pulley blocks which are engageable individually with individual first cords, and which are moveable with respect to the weaving device frame;

a frame module detachably mounted on the weaving device frame, and wherein the frame module has opposite first and seconds ends and a pair of spaced sidewalls, and wherein a channel is formed in the sidewalls adjacent the second end thereof, and wherein griff tracks are disposed on the spaced sidewalls, and wherein the frame module is readily detachable from the respective eyelets and weaving device frame;

a plurality of second pulley blocks, and wherein each of the second pulley blocks is releasably connected to an individual one of the first pulley blocks;

a plurality of hooks selectively moveable relative to the frame module, and wherein each of the hooks has a pulley wheel rotatably mounted thereto, and wherein each of the hooks is selectively movable between a first and second position, and wherein in the first position the respective hooks are located near the first end of the frame module, and wherein in the second position, the hooks are located near the second end of the frame module;

a plurality of second cords each having opposite first and second ends, and wherein the first and second ends of each of the second cords are mounted on the frame module, and wherein the pulley wheels of pairs of the hooks are engaged by individual ones of the second cords intermediate the first and second ends;

wherein the second cords are individually connected to individual ones of the second pulley blocks;

a plurality of latches movably mounted on the frame module, and wherein each latch is moveable between a latched position and an unlatched position, and wherein each latch is biased toward the latched position, and wherein each of the hooks is selectively engageable with an individual latch when the hook is located in the second position, and the latch is located in the latched position;

a plurality of solenoids mounted on a supporting substrate, and wherein the supporting substrate is slidably engageable within the channel, and wherein the respective solenoids have an energized and a de-energized state, and wherein the respective solenoids facilitate selective retention of the respective latches in the unlatched positions;

a griff bar selectively movably borne on the frame module and movable along the griff tracks, and wherein the griff bar has a reciprocal path of movement, and wherein the griff bar is selectively engageable with selected hooks, to reciprocally move the selected hooks from the second position of the hook to the first position thereof;

first and second pairs of wheels, each pair of wheels rotatably mounted on one of the opposite sidewalls of the frame module; and a drive member disposed in force transmitting relation between the respective first and second wheels and the griff bar.

39. A weaving device as claimed in claim 38, wherein the frame module has a first side and an opposite second side, and wherein the solenoids are located on the first side.

40. A weaving device as claimed in claim 39, wherein the latches and hooks are located on the first side.

41. A weaving device as claimed in claim 40, wherein the frame module further comprises a pair of griff bars each selectively movably borne on the frame module and each movable along the griff tracks, and wherein each griff bar is selectively engageable with a predetermined number of the hooks, and wherein each of the griff bars is disposed in force transmitting relation to the drive member such that the direction of movement of one griff bar is opposite to the direction of movement of the other griff bar.

42. A weaving device as claimed in claim 38, wherein the position of each of the griff bars with respect to the drive member is adjustable.

43. A weaving device as claimed in claim 42, and further comprising an actuator releasably disposed in force transmitting relation to one of the griff bars, and wherein the actuator transmits a motive force to the griff bar.

44. A weaving device as claimed in claim 43, and further comprising a controller releasably electrically coupled to the solenoids, and wherein the controller selectively energizes each of the individual solenoids.

45. A frame module for use with a weaving device having a plurality of eyelets, and wherein the frame module controls movement of the respective eyelets, the frame module comprising:

a module frame releasably engageable with the weaving device and mountable to the weaving device;

a plurality of hooks movably borne by the module frame and configured for releasable attachment to the eyelets;

a plurality of latches mounted on the module frame, each being moveable between a latched position and an unlatched position;

a plurality of solenoids releasably mounted on the module frame;

wherein the respective solenoids are configured to facilitate movement of the respective latches;

a griff bar movably borne on the module frame and selectively engageable with selected hooks to move the selected hooks between first and second positions;

a drive assembly on the frame and operable to move the griff bar selectively along the frame to engage and move selected hooks between the first and second positions; and wherein the module is a removable component of the weaving device.

46. The frame module of claim 45 further comprising:

pulley blocks configured to be releasably attached to eyelets of the weaving device;

a plurality of cords each having opposed cord ends mounted to the module frame and each mounting a pulley block intermediate the opposed cord ends;

wherein each of the hooks includes a pulley;

wherein the hooks are mounted in pairs by way of the pulleys thereon to individual cords intermediate the cord ends thereof.

* * * * *